US006892559B2

(12) United States Patent
Leiponen

(10) Patent No.: US 6,892,559 B2
(45) Date of Patent: May 17, 2005

(54) METHOD AND APPARATUS FOR MANUFACTURING TUBES

(75) Inventor: Matti Leiponen, Helsinki (FI)

(73) Assignee: Outokumpu Oyj, Espoo (FI)

( * ) Notice: Subject to any disclaimer, the term of this patent is extended or adjusted under 35 U.S.C. 154(b) by 6 days.

(21) Appl. No.: 10/450,424

(22) PCT Filed: Dec. 11, 2001

(86) PCT No.: PCT/FI01/01076

§ 371 (c)(1),
(2), (4) Date: Jun. 11, 2003

(87) PCT Pub. No.: WO02/49781

PCT Pub. Date: Jun. 27, 2002

(65) Prior Publication Data

US 2004/0007033 A1 Jan. 15, 2004

(30) Foreign Application Priority Data

Dec. 20, 2000 (FI) ..... 20002798

(51) Int. Cl.[7] ..... B21B 9/00
(52) U.S. Cl. ..... 72/38; 72/96; 72/98
(58) Field of Search ..... 72/234, 235, 200, 72/366.2, 38, 96, 97, 98, 99, 100, 69, 110, 236

(56) References Cited

U.S. PATENT DOCUMENTS

| | | | | | |
|---|---|---|---|---|---|
| 4,318,294 | A | * | 3/1982 | Yoshiwara et al. | 72/97 |
| 4,578,974 | A | * | 4/1986 | Pozsgay et al. | 72/97 |
| 4,722,209 | A | * | 2/1988 | Mankins | 72/38 |
| 4,727,747 | A | * | 3/1988 | Naud et al. | 72/38 |
| 4,738,128 | A | * | 4/1988 | Staat | 72/96 |
| 4,928,507 | A | * | 5/1990 | Staat et al. | 72/38 |
| 6,651,473 | B2 | * | 11/2003 | Roller | 72/69 |

FOREIGN PATENT DOCUMENTS

| | | | | |
|---|---|---|---|---|
| DE | 2929401 | * | 2/1981 | B21B/9/00 |

* cited by examiner

*Primary Examiner*—Ed Tolan
(74) *Attorney, Agent, or Firm*—Smith-Hill and Bedell

(57) ABSTRACT

A method for manufacturing a tube made of a non-ferrous material, particularly a tube made of mainly copper, in which method, in the first working step the tube billet is worked so that mainly owing to the deformation resistance, the temperature of the tube billet under operation rises up to the recrystallization range, at least on the spot that is being worked. Essentially immediately after the first working step, the tube billet is subjected to at least a second working step and the tube billet is maintained, at least during the first and second working step in non-oxidizing conditions. the invention also relates to an apparatus.

25 Claims, 3 Drawing Sheets

METHOD AND APPARATUS FOR MANUFACTURING TUBES

CROSS REFERENCE TO RELATED APPLICATION

Figure 1:
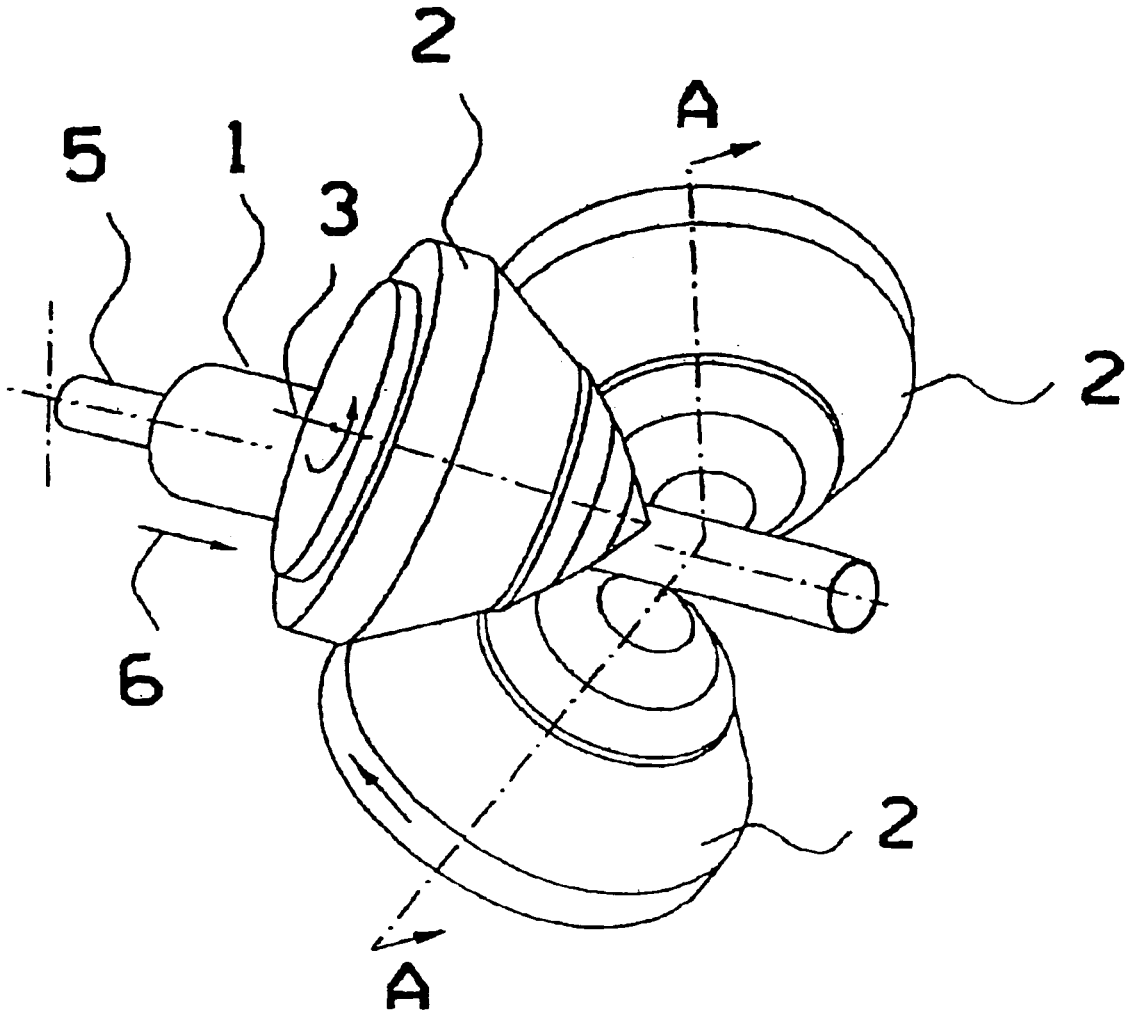

This is a national stage application filed under 35 USC 371 based on International Application No. PCT/FI01/01076 filed Dec. 11, 2001, and claims priority under 35 USC 119 of Finnish Patent Application No. 20002798 filed Dec. 4 20, 2000.

The present invention relates to a method and apparatus for manufacturing tubes.

From the U.S. Pat. No. 4,876,870, there is known a method for manufacturing tubes of a non-ferrous metal, where a continuously cast billet is cold worked for instance by planetary rolling, so that owing to the influence of deformation resistance, the temperature of the worked material rises to the recrystallization range. In said publication, cold working generally means a process where the temperature of the billet under operation is normal when staring the working, but rises along with the process essentially higher than in an ordinary cold working operation, i.e. up to the recrystallization range of the material. A planetary rolling arrangement suited to implementing a prior art method is disclosed in the U.S. Pat. No. 3,735,617, where three conical rolls are arranged at angles of 120° with respect to each other. The rolls rotate both around their own axis and around the center of the planetary housing. In said arrangement, the mainly conically narrowing shape of the rolls is essentially narrowed in the proceeding direction of the material to be rolled. There are also known corresponding planetary rolling arrangements, particularly applied in the rolling of steel tubes, where the rolls are arranged in a reversed position with respect to the proceeding direction of the rolled material, in which case their conical shape is narrowed against the proceeding direction of the material to be rolled.

The U.S. Pat. No. 4,510,787 introduces a method for manufacturing hollow rods, where one possibility is to employ mainly conical rolls that are narrowed in an opposite direction than the proceeding direction of the rolled material.

Copper tubes have been manufactured extremely successfully by using the method of the prior art. However, if production capacity should be increased, the current method and particularly the employed equipment have some drawbacks. An increase in the production capacity requires an increase in the rolling speed. The structures of current rolling mills, particularly the structures of the roller heads, are ill suited to increasing the rolling speed and the rolling mill rotation speed. This is due to the forces required to hold the roller heads in position during their rotation, among others.

The object of the invention is to realize a method whereby production capacity can be increased economically. Another object of the invention is to realize an apparatus whereby the drawbacks of the prior art can be avoided and production capacity increased.

The invention is based on the observation that the working resistance of copper is diminished to a fraction after recrystallization. This enables an extremely economical further working of the tube billet with an equipment that is remarkably more economical than in the first working step.

The method according to the invention has several remarkable advantages. The division of the working process into two steps enables, among others, after the first working step, a larger wall thickness of the tube billet than in the method of the prior art, which results in an increase in the production capacity. The working of the tube billet—which is in the first working step recrystallized and softened—in the second working step immediately after the first working step only requires a slight amount of power of the working arrangement. Moreover, the invention enables extremely versatile working conditions in the second working step. The second working step can be carried out with one or several roll arrangements. There can be applied planetary rolling, stretch reducing or sizing rolling. Apart from diminishing the tube billet diameter, said diameter can also be enlarged in the second working step. Optimal conditions for the working steps are achieved by adjusting the tube billet temperature.

In the present application, a conical roll generally means a rolling mill roll with a diameter that is at the rolling surface, at the first end of said rolling surface, larger than at the second end. The true shape of the conical roll does not necessarily have to be conical or frusto-conical, but it can be varied according to the particular embodiment. Planetary rolling generally means rolling where the rolls rotate both around their own axis and around the billet to be rolled.

Figure 2:
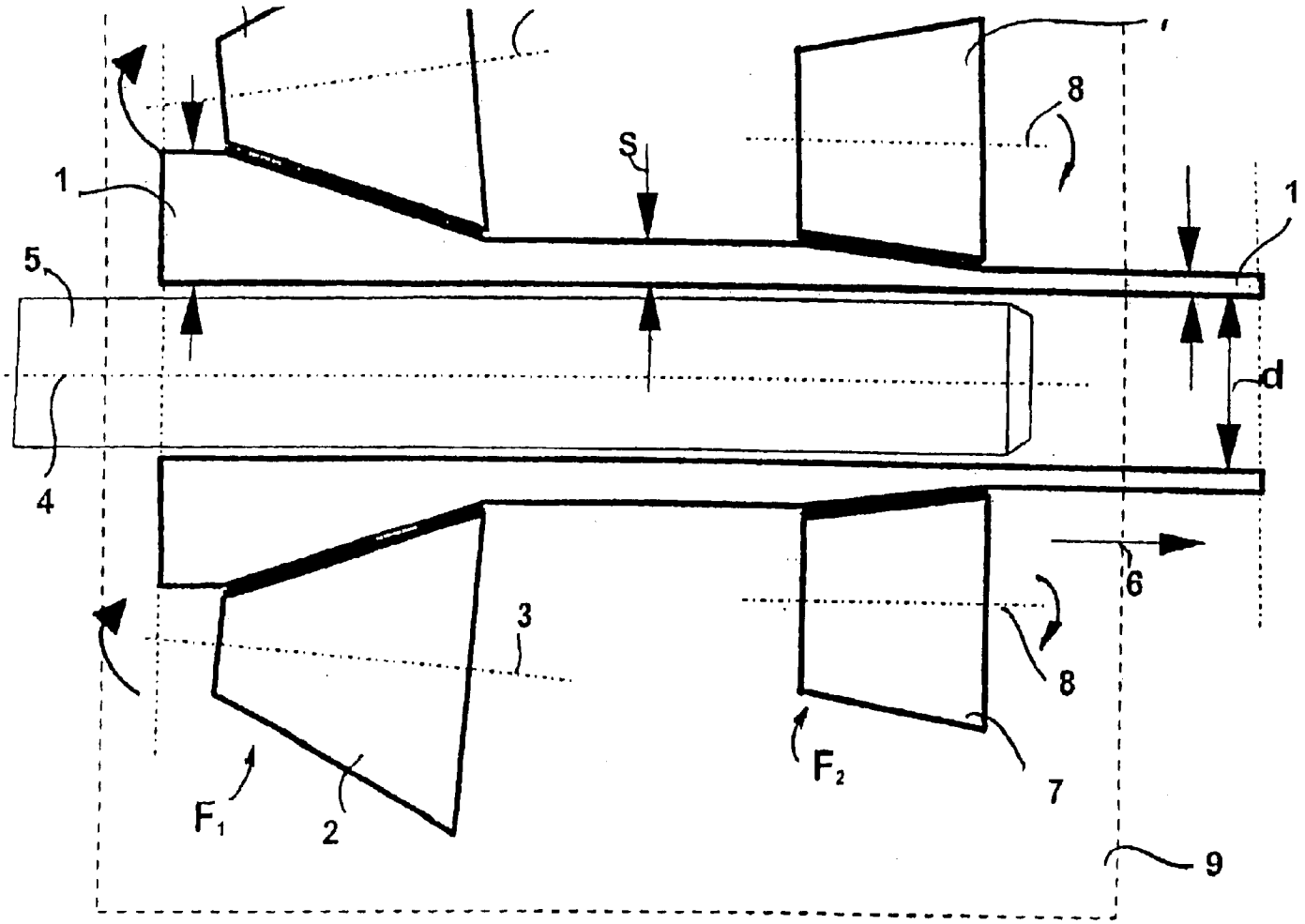
Figure 3:
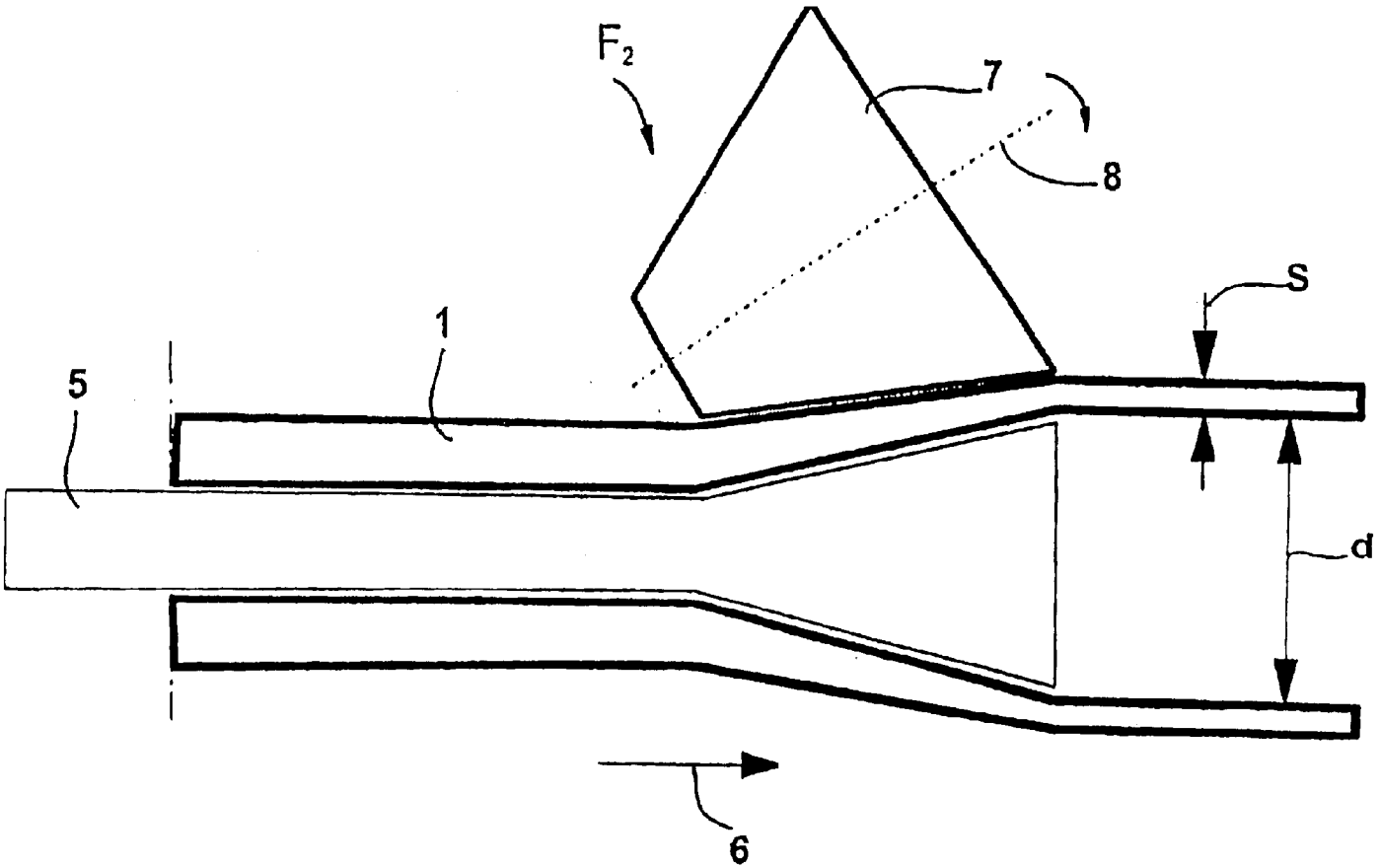

The invention is explained in more detail below, with reference to the appended drawings, where FIG. 1 is a simplified illustration of a prior art arrangement, FIG. 2 is a simplified illustration of a method according to the invention, and FIG. 3 illustrates a detail of an embodiment according to the invention.

FIG. 1 illustrates a prior art solution for working a tube billet 1 by rolling. In the prior art arrangement, the tube billet 1 is planetary rolled in one working step mainly with conical roll elements 2, which will be called conical rolls in the text below. Each of the conical rolls 2 rotates around its rotary axis 3, and in addition, the rolls typically rotate essentially around the rotary axis of the planetary housing, which axis is parallel to the central axis 4 of the tube billet. During rolling, there is typically used a mandrel 5 inside the tube billet. In the drawing, the motional direction of the tube billet is indicated by the arrow 6. For the sake of clarity, the moving and drive gear of the conical rolls 2 is left out of the drawing. Some typical rolling arrangements utilizing conical rolls are disclosed for instance in the publications U.S. Pat. No. 3,735,617 and GB 2019281 A.

FIG. 2 is a simplified illustration of an embodiment according to the method of the present invention, shown in cross-section along the line A—A of FIG. 1.

Accordingly, for example a continuously cast tube billet 1 is brought to a working step according to the invention. In the first working step $F_1$ of the method, the tube billet is worked so that the temperature of the tube billet to be worked rises, mainly owing to the influence of deformation resistance, up to the recrystallization range or in the vicinity thereof, at least in the spot that is being worked. The first working step $F_1$ is carried out by a first rolling mill device. The first rolling mill device includes at least one, preferably several rolls 2. In the embodiment of FIG. 2, the conical rolls 2 rotate around their axis 3 and also around the center of the planetary housing, for instance, which housing is typically located on the central axis 4 of the tube billet 1. Inside the tube billet 1, there is typically employed a mandrel 5, in which case the wall of the tube billet 1 is worked between the rolls 2 and the mandrel 5. Typically, in the first working step, the degree of working, the wall thickness of the tube billet under operation and the mass flow are chosen so that there is achieved a maximum mass flow, and that there are good conditions for recrystallization. Typically the tube billet is cold worked in the first working step.

Essentially immediately after the first working step $F_1$, the tube billet is subjected to a second working step $F_2$. At least during the first working step $F_1$ and the second working step $F_2$, and advantageously also between said working steps, the tube billet 1 is kept in non-oxidizing conditions. Said non-oxidizing conditions are created for instance by means of a protective gas space 9, where the conditions are adjusted in order to at least partly prevent the oxidation of the tube billet. The employed protective gas can typically be for example nitrogen or argon.

According to a preferred embodiment of the method according to the invention, in the second working step $F_2$ the wall thickness s of the tube billet 1 is diminished. Typically the wall thickness of the tube billet 1 is diminished for about 50–70% in the second working step $F_2$. The second working step $F_2$ may comprise several successive rolling steps. In a typical embodiment, in the second working step $F_2$ the tube billet 1 is worked by planetary skew rolling or planetary cross-rolling. In another embodiment, in the second working step $F_2$ the tube billet 1 is worked by stretch reducing. In a third embodiment, the tube billet is worked by applying sizing rolling. Different types of working processes can also be combined in succession.

The method according to the invention provides wider possibilities for working than the prior art. In the second working step $F_2$, the (inner) diameter d of the tube is maintained essentially constant. In another preferred embodiment, the tube diameter d is enlarged in the second working step $F_2$ (FIG. 3). The tube diameter d is enlarged by using, when necessary, a mandrel 5 inside the tube billet. In FIG. 3, the diameter of the mandrel 5 is enlarged at the second working spot conically towards the output direction 6 of the tube billet. In a typical case, the wall thickness s of the tube billet is simultaneously diminished. In a preferred embodiment, the tube billet diameter d can also be diminished in the second working step $F_2$.

In the method according to the invention, the (inner) diameter d and the wall thickness s of the tube billet can be adjusted to the desired measures in a way that is remarkably more flexible than those used in the prior art, without having to restrict the capacity.

When necessary, the temperature of the tube billet is adjusted, either prior to the first working step, during it, prior to the second working step or during it. Heating can be carried out for instance by using an induction coil. Naturally the billet can also be cooled.

The apparatus according to the invention for working the tube billet comprises in the first working step $F_1$ a rolling mill arrangement with at least one roll element 2. Essentially immediately after the rolling arrangement of the first working step $F_1$, in the proceeding direction 6 of the tube billet 1, there is arranged the rolling arrangement of the second working step $F_2$. The apparatus includes a protective gas space 9 for protecting the tube billet 1, at least at the first working step $F_1$ and the second working step $F_2$ of the rolling arrangement and advantageously also therebetween.

Typically the protective gas space 9 surrounds, at least partly, the rolling arrangement of both the first and the second working step, and also the space provided in between, at least in the vicinity of the tube billet 1.

In a typical embodiment, the diameter of the roll element of the rolling arrangement of the first working step $F_1$ is larger on the input side of the tube billet than on the output side (as is seen in FIG. 1). According to another embodiment, the diameter of the roll element 2 of the first rolling arrangement is larger on the tube billet output side than on the tube billet input side (according to FIG. 2). Typically the first rolling arrangement is a planetary mill with at least three conical roll elements 2 provided as the employed rolling elements.

In the embodiment of FIG. 2, at least one of the rolling arrangements of the second working step $F_2$ is a planetary mill.

In a preferred embodiment, the rotary axis 8 of the roll 7 of the rolling arrangement of the second working step is parallel to the longitudinal axis 4 of the tube billet 1.

Typically the rotary axis 8 of at least one roll 7 of the rolling arrangement of the second working step forms an angle with the longitudinal axis 4 of the tube billet.

In an embodiment, the rotary axis 8 of at least one roll 7 of the rolling arrangement of the second working step is essentially perpendicular to the plane that is tangential to the longitudinal axis 4 of the tube billet 1.

Thus the roll arrangement of the rolling apparatus of the second working step can consist of conical roll elements, or roll elements with rotary axes that are perpendicular to the proceeding direction of the tube billet, or of a combination of these.

The apparatus comprises at least one mandrel element 5. The shape and size of said mandrel element depends on the embodiment in question. FIG. 3 illustrates an embodiment where the (inner) diameter d of the tube billet 1 is diminished. At the same time, the wall thickness s of the tube billet 1 is diminished. The diameter of the mandrel 5 is diminished conically at the working spot towards the output direction 6 of the tube billet 1.

The invention is mainly suited to the manufacturing of tubes made of a non-ferrous material. In particular, the invention is designed to the manufacturing of copper or copper alloy tubes.

What is claimed is:

1. A method for manufacturing a tube made of a non-ferrous material, comprising:

feeding a tube billet in a predetermined feeding direction through a first working station and a second working station, wherein the second working station is downstream of the first working station with respect to the feeding direction of the tube billet and the second working station is so located relative to the first working station that simultaneously a first length segment of the tube billet is located in first working station and a second length segment of the tube billet is located in the second working station and a length segment of the tube billet that leaves the first working station substantially immediately enters the second working station, working the tube billet in the first working station so that mainly owing to deformation resistance, the temperature of the tube billet under operation rises up to the recrystallization range, at least on the working spot, working the tube billet in the second working station, and keeping at least the first and second length segments of the tube billet in non-oxidizing conditions.

2. A method according to claim 1, wherein the second length segment of the tube billet is separated from the first length segment of the tube billet by a third length segment that is between the first and second working stations, and the method comprises keeping the third length segment of the tube billet in non-oxidizing conditions.

3. A method according to claim 1, comprising providing the non-oxidizing conditions by means of a protective gas chamber which contains protective gas.

4. A method according to claim 1, comprising cold working the tube billet in the first working station.

5. A method according to claim 1, comprising reducing the wall thickness of the tube billet in the second working station.

6. A method according to claim 1, comprising reducing the wall thickness of the tube billet by about 50–70% in the second working.

7. A method according to claim 1, comprising keeping the diameter of the tube billet essentially constant in the second working station.

8. A method according to claim 1, comprising reducing the diameter of the tube billet in the second working station.

9. A method according to claim 1, comprising increasing the diameter of the tube billet in the second working station.

10. A method according to claim 1, comprising rolling the tube billet with at least one roll in the second working station.

11. A method according to claim 1, comprising rolling the tube billet in the first working station.

12. A method according to claim 1, comprising rolling the tube billet in at least one of the working stations.

13. A method according to claim 1, wherein the tube billet is a continuously cast billet.

14. A method according to claim 1, comprising adjusting the temperature of the tube billet when necessary.

15. An apparatus for working a tube billet, said apparatus comprising:

first and second rolling arrangements, wherein the second rolling arrangement is downstream of the first rolling arrangement with respect to a feeding direction of the tube billet and the second rolling arrangement is so located relative to the first rolling arrangement that simultaneously a first length segment of the tube billet is located in the first rolling arrangement and a second length segment of the tube billet is located in the second rolling arrangement and a length segment of the tube billet that leaves the first rolling arrangement substantially immediately enters the second rolling arrangement, wherein the first rolling arrangement comprises a planetary arrangement including at least one roll element for performing a first working step and the second rolling arrangement performs at least a second working step, and means for creating non-oxidizing conditions, so that at least during the first and second working steps the tube billet is kept in non-oxidizing conditions.

16. An apparatus according to claim 15, wherein the means for creating non-oxidizing conditions comprise at least one protective gas chamber.

17. An apparatus according to claim 15, wherein the protective gas chamber surrounds the first and second rolling arrangements and the space provided therebetween at least in the vicinity of the tube billet.

18. An apparatus according to claim 15, wherein the roll element of the first rolling arrangement is a conical roll element and the conical roll element of the first rolling arrangement decreases in diameter in the feeding direction of the tube billet.

19. An apparatus according to claim 15, wherein the roll element of the first rolling arrangement is a conical roll element and the conical roll element of the first rolling arrangement increases in diameter in the feeding direction of the tube billet.

20. An apparatus according to claim 15, wherein the first rolling arrangement is a planetary mill comprising at least three conical roll elements.

21. An apparatus according to claim 20, comprising at least one other rolling arrangement that is a planetary mill.

22. An apparatus according to claim 15, wherein the second rolling arrangement includes at least one roll having a rotary axis that is inclined to the longitudinal axis of the tube billet.

23. An apparatus according to claim 15, wherein the second rolling arrangement includes at least one roll having a rotary axis that parallel to the longitudinal axis of the tube billet.

24. An apparatus according to claim 15, wherein the second rolling arrangement includes at least one roll having a rotary axis that is essentially perpendicular to a plane that is tangential to the longitudinal axis of the tube billet.

25. An apparatus according to claim 15, comprising at least one mandrel element.

* * * * *